US007137881B2

(12) United States Patent
Walling

(10) Patent No.: US 7,137,881 B2
(45) Date of Patent: Nov. 21, 2006

(54) PROTECTIVE BED UNIT

(76) Inventor: Jeffrey L. Walling, 1201 Eydon Ct., Virginia Beach, VA (US) 23464

( * ) Notice: Subject to any disclaimer, the term of this patent is extended or adjusted under 35 U.S.C. 154(b) by 389 days.

(21) Appl. No.: 10/773,677

(22) Filed: Feb. 6, 2004

(65) Prior Publication Data

US 2004/0158920 A1 Aug. 19, 2004

Related U.S. Application Data

(60) Provisional application No. 60/475,464, filed on Jun. 3, 2003, provisional application No. 60/446,965, filed on Feb. 13, 2003.

(51) Int. Cl.
*F24F 7/007* (2006.01)

(52) U.S. Cl. ..... 454/251; 5/423

(58) Field of Classification Search ..... 454/254, 454/251; 5/423, 424, 421
See application file for complete search history.

(56) References Cited

U.S. PATENT DOCUMENTS

| | | | | | |
|---|---|---|---|---|---|
| 3,724,172 | A * | 4/1973 | Wood | 95/287 |
| 4,017,917 | A * | 4/1977 | Brown | 5/617 |
| 5,111,543 | A * | 5/1992 | Epshetsky et al. | 5/424 |
| 5,575,024 | A * | 11/1996 | You | 5/424 |
| 5,975,081 | A * | 11/1999 | Hood et al. | 128/845 |
| 6,001,057 | A * | 12/1999 | Bongiovanni et al. | 600/21 |
| 6,487,735 | B1 * | 12/2002 | Jacques et al. | 5/424 |

* cited by examiner

*Primary Examiner*—Derek S. Boles
(74) *Attorney, Agent, or Firm*—Goldizen & Associates; Bradley D. Goldizen

(57) ABSTRACT

A protective bed includes a shield comprising bullet-proof and impact resistance material that surrounds a metal frame. The shield operably separates to provide access to an interior sleeping area. Quick access doors are located on either side of the bed. A ventilation system provides for climate control as well as filtering harmful substances from the air. A rebreather scrubs carbon dioxide from air within the unit to allow a user to close the unit to outside air.

15 Claims, 17 Drawing Sheets

PROTECTIVE BED UNIT

This application claims priority from U.S. Provisional Patent Application Ser. No. 60/446,965 filed on Feb. 13, 2003 and U.S. Provisional Patent Application Ser. No. 60/475,464 filed on Jun. 3, 2003.

This application did not receive any federal research and development funding.

BACKGROUND OF THE INVENTION

The present invention relates generally to a safe environment to which an individual may retreat for protective or rest purposes. More specifically, the invention relates to a protective sleep unit that includes multiple protective and convenience features. This invention is directed towards providing users with a high-level security system for use during sleeping periods. It also acts as a place of retreat and defense against those desiring to inflict bodily harm upon a user. Lastly, the invention might be used as a protective environment during biological or chemical attacks and natural disasters.

A safe room is a room having a reinforced door and walls for use in emergencies such as tornados or when an intruder enters a dwelling. Typically, the walls of the safe room comprise concrete or steel to protect individuals or items inside the safe room. Safe rooms have been used as a form of protection for many years. Safe rooms are limited in their use because of their weight and size. Ordinarily, they are built during an initial construction of a residence or during a remodeling of the residence. Alternatively, an installer fabricates the safe room outside the residential dwelling and hauls it into place.

Problems that exist with a safe room include reinforcing structural members under and around the safe room during initial construction or remodeling of the residence. Hauling a safe room into place may require the removal of doors and/or walls. Thus, there are many problems associated with the use and installation of safe rooms.

The present invention overcomes many of these problems associated with safe rooms. The protective unit of the present invention is shipped to a residence and constructed on-site. Individual or component parts are carried through standard-sized entryways thereby alleviating the need to remove doors and walls. Additionally, it does not require any further reinforcement of structural members within the residence.

It is an object of the invention to provide a high-level security unit that includes a protective barrier between an intruder or dangerous environmental condition and a user.

It is another object of the invention to provide a unit that includes high-level security during periods of sleep. The unit might be equipped with various sensors to alert a user when an intruder has entered the user's dwelling.

It is a further object of the invention to provide a unit that includes a bulletproof shielding material for protecting an occupant. The shielding material is durable such that it can withstand the impact of large objects such as sledge hammers, wrecking bars and the like.

It is an additional object of the invention to provide a sealed environment that protects an occupant from chemical, biological or other harmful airborne contaminants. The sealed unit may be used as a positive pressure system, that allows the user to bring in fresh filtered air and keep offensive agents such as pollen, mold spores, radioactive fallout, or viruses like SARS from entering the unit. Alternatively, the unit may be used as a negative pressure system to create an isolation environment that allows the user to contain events caused by airborne particles (like the transfer of a contagious virus).

It is another object of the invention to provide a secured area that allows a user to see an area external to the closed unit while preventing others from peering into the unit.

It is another object of the invention to provide a protective unit that protects against terrorism or, harmful biological agents such as Anthrax. The unit includes a security system for detecting intruders and reacting thereto. Bullet proof shielding protects the occupant from weapons of mass destruction including biological and chemical warfare. The unit can be operated as a safe room or bomb shelter. It may be used to prevent kidnappings, or protect the occupant from natural disasters such as tornados, hurricanes, earthquakes and floods.

These objects and others will become apparent when the aforementioned discussion is taken in conjunction with the following disclosure.

BRIEF SUMMARY OF THE INVENTION

The present invention is a protective bed that includes a cover comprising plating or shielding material that encapsulates the bed when closed. This shielding comprises material that prevents bullet penetration as well as high impact blows. It also protects an occupant from forced entry and may provide a sealed environment to protect the occupant from harmful chemical or biological agents.

The shielding comprises a canopy, leg cover, side and foot frame plating, back headboard plating and side headboard plating, as well as at least one access door. Typically, the shielding constitutes 1.25" polycarbonate plating. However, it is contemplated that other known materials may be substituted for the polycarbonate plating. For example, the unit may be built with aluminum, steel, plastic or wooden bed frame and headboard with shielding options of wood panels, plastic, or aluminum sheet panels. The options for the canopy, leg covers, bed frame and headboard plating may comprise aluminum or steel plating, wood paneling, formed plastic, Plexiglas, thin polycarbonate or any combination of these materials. The shielding can be fitted with Kevlar®), a material designed to stop bullet penetration. The unit can be fabricated to provide a sealed temporary environment from harmful gasses. Access to the interior of the shielding material is gained through actuators discussed hereinafter.

A shield operating system includes actuators or screw jacks for opening and closing the shielding and doors, such as those sold by Thomson Industries under the model number 12 VDC PPA or the Warner Electrak® E050 electromechanical linear actuator. The screw jacks include expansion boots that are rubber and cover the moving parts to prevent accidental contact with the moving parts during operation. Since the cover and doors are hinged externally, the actuators act as the locking mechanisms for the covers and doors when in the fully closed position to seal the unit and protect an occupant from forced entry. At least one screw jack actuator is provided for each the canopy and the leg covering. Each door is equipped with a door actuator that operates to open and close the doors. Each door actuator is fitted with a quick release button to allow the doors to be opened from inside the unit should a power failure occur. The quick release buttons are accessed through cover doors in the headboard that include flip guards for preventing accidental release during an emergency condition.

This invention is aimed at providing users with a high-level security system during normal sleep periods. It can also be used for a place of retreat and defense against perpetrators such as burglars or other criminals that may break into homes with the intent of harming the homeowners or occupants. It is also suitable as a protective environment during times of biological warfare, chemical warfare or other harmful gas attack. The invention is intended for use by the public at large and has potential uses in the medical community. Governmental use may include protection of important government officials such as dignitaries and ambassadors from terrorism and weapons of mass destruction. In one embodiment, the unit comprises an aluminum bed frame and headboard with attached polycarbonate, bullet proof plating that is designed to provide a protective barrier (cover shields) between a perpetrator or environmental condition and the homeowners or occupants. An aluminum bed frame and headboard supports the bedding and shield covers. Sealant is applied between the frame and shielding to assure that an airtight environment is created when the unit is closed. The aluminum bed frame and headboard support the bedding and the shield covers.

The bulletproof polycarbonate barrier is designed to stop bullet penetration, blows from impact, forced entry and provide a sealed temporary safe room and environment from burglars, terrorists or harmful gasses. It also provides protection from the destructive forces of tornados, hurricanes, earthquakes and floods.

The unit can also be fitted with defensive devices such as a tear gas spraying device, robotic arms, or weaponry that propels projectiles. It is designed to enable the person(s) inside the unit to see out and prevent those outside from seeing in. The unit may be equipped with a bio-chemical filter system to counter bio-chemical attacks and a rebreather system to enable the operator to seal off all outside air and provide breathable air for a specified amount of time. This system might be used in such a case where the unit operator may need to release tear gas or another form of gaseous material in defense against a burglar or terrorist. The rebreather system is also useful as the ultimate protection (safe room) from weapons of mass destruction that may be used during biological and chemical acts of warfare or other type gas attack that could release various forms of pathogens or hazardous gases.

There are doors on either side of the unit next to the headboard. The doors are equipped with actuators that include an emergency release button. When pressed, the emergency release causes the actuator to separate into two pieces. When separated, the actuator releases to allow the door to open. This feature is useful in case of mechanical failure of the actuator or loss of power to the operating systems that control the actuator.

A control panel controls operating systems such as venting, opening and closing of the cover shield, telephone systems, sound systems such as audio amplifiers, microphones, radio and television systems, defensive systems, alarm systems, oxygen sensors, motion detection systems, and smoke detection systems.

The unit may comprise an external keypad and remote control device for gaining entry to a closed unit. The unit also includes an environmental air conditioning and heating control system that regulates the internal temperature of the unit. The unit may comprise an alternative power source such as a battery system to provide power in the event of a failure or interruption of power in the primary power source. The unit might include automatic switching circuitry for switching from the primary to the alternative power source. The unit may also be equipped with a toilet or other plumbing system.

The unit may be shaped in a circular instead of rectangular shape. It may include fire resistant materials such as fire retardant plastics and water circulation systems. It may be equipped with a video screen adapted to the head cover shield for playing video games and for computer hookups. Moreover, the unit may include integrated PC systems. Family systems comprising two or more units may be electronically linked together such that a parent or guardian can remotely operate a child's unit from the parent's sleeper. Communication systems allow audio and video communications between the units for viewing and talking with one another from the safety of the units.

The unit includes a control panel that allows a user to select between different modes such as basic system operations, an intruder setting, an emergency status, and a lock down mode. The cover and door actuators include an emergency release. The unit may include a one-way see-through head cover comprising a reflective mirror on two sides and the front.

The unit comprises a sensor system that includes sensory features such as a proximity sensor, oxygen sensor, smoke detector and motion detector. It may include an emergency communications system comprised of a cellular telephone or radio frequency transceivers. The unit may comprise convenience accessories such as a stereo system including a radio, compact disc player, DVD player, personal computer system, microwave oven and refrigerator. An external camera and video system may be provide for viewing areas outside the unit.

When the unit protects against natural disasters, it is secured on a ground floor with a concrete slab foundation and anchored to a solid base to resist the forces of wind and water.

Airtight and watertight seals surround the edges of the doors and along the edges where the shielding separates during opening and closing. The seal may be a seal comprised of ribbed sections and sold by Clean Seal Inc. A sealant is applied between the frame and headboard plating to assure an airtight seal. The matting surfaces of the covers and doors include grooves with rubber seals inserted into the grooves. The seals are ribbed EPDM material and can contain an atmospheric pressure between 5–9 psi depending upon the percent of compression. The unit is designed to compress the seal to 20% which will hold greater than 7psi. Additional stainless steel bridge structuring that incorporates angled designs is an optional feature that can be added to the head and leg covers. This additional bracing reinforces the polycarbonate plating for protection from earthquakes, tornadoes, hurricanes and flood waters.

The unit includes a ventilation system that comprises filters and a rebreather. The unit may also be equipped with a heating and air conditioning system. The ventilation system is designed to circulate air through the unit while in the open or normal settings. The air may be circulated across heating or cooling coils to regulate the internal temperature of the unit. It automatically shuts off when sensing external hazardous conditions. The system includes filters, filter housing, a circulation fan, inlet and outlet isolation valves and ducting. The filter may be an ASR-48NBC filter sold by American Safe Rooms, Inc. Air flows in through filters located at the headboard end of the unit and out through openings located at the foot of the unit. Various filters may be used to satisfy individual needs. Some of these may include Hepa filters, dust filters, or biological and chemical filters. The filter housing transitions air flow from the filter to the ducting system. The ventilation system controls an internal atmosphere of unit to regulate temperature and humidity to a desired comfort level In the preferred embodiment, the duct system comprises 1.25" duct. A fan circulating air throughout the unit may be activated by sensor input in response to environmental changes such as temperature and humidity. Alternatively, the fan may be operated on a continual basis. Vent isolation valves open and close main venting and rebreather systems. The valves used may be model number 62416 Parker solenoid valve 12VDC sold by valvestore.com. These isolation valves are automatically controlled by an $O_2$ sensor, smoke detector and LEL sensor. The valves are biased towards an open position such that when power failure occurs, they assume an open position. Redundant ducting provides a safety feature should fan failure occur or a valve become stuck in a closed position.

A rebreather provides oxygenated air for breathing when the venting systems are closed for protection from hazardous external atmospheric conditions. The rebreather is activated when the ventilation system is shut off. The isolation valves open and the ventilation system circulates air throughout the unit. The rebreather provides a breathable atmosphere for up to 3 days. The rebreather system acts to remove or "scrub" carbon dioxide from the air and inject small amounts of oxygen back into the air stream. After the system is exhausted, such that it can no longer remove carbon dioxide from the air, the main ventilation system automatically opens to draw in air from outside the unit. That is to say, the unit is designed switch over from the rebreather to the outside atmosphere when the rebreather can no longer scrub carbon dioxide from the air and the oxygen level drops below a safe level, for example 19.5%. If activation of the ventilation system fails to restore internal oxygen to a safe level after a preset period of time, the unit opens the shielding or doors in an effort to raise the oxygen level.

The unit includes a mattress and box springs. It also may include LEDs or other indicator lights that alert a user of a specific condition. Audible and visual alarms may be included in the unit for indicating the existence of a dangerous condition. The controller may include automatic responses to various environmental stimuli. For example, a glass breakage alarm may detect the sound of glass breaking in the house in which the unit is located. The unit may automatically close the shielding to protect an occupant. Authorities may then be alerted by the unit.

DETAILED DESCRIPTION OF THE INVENTION

The following is the preferred embodiment or best mode for carrying out the invention. It should be noted that this invention is not limited by the discussion of the preferred embodiment, but that skilled artisans may easily recognize that certain modifications may be made without deviating from the spirit of the invention.

Figure 1A:
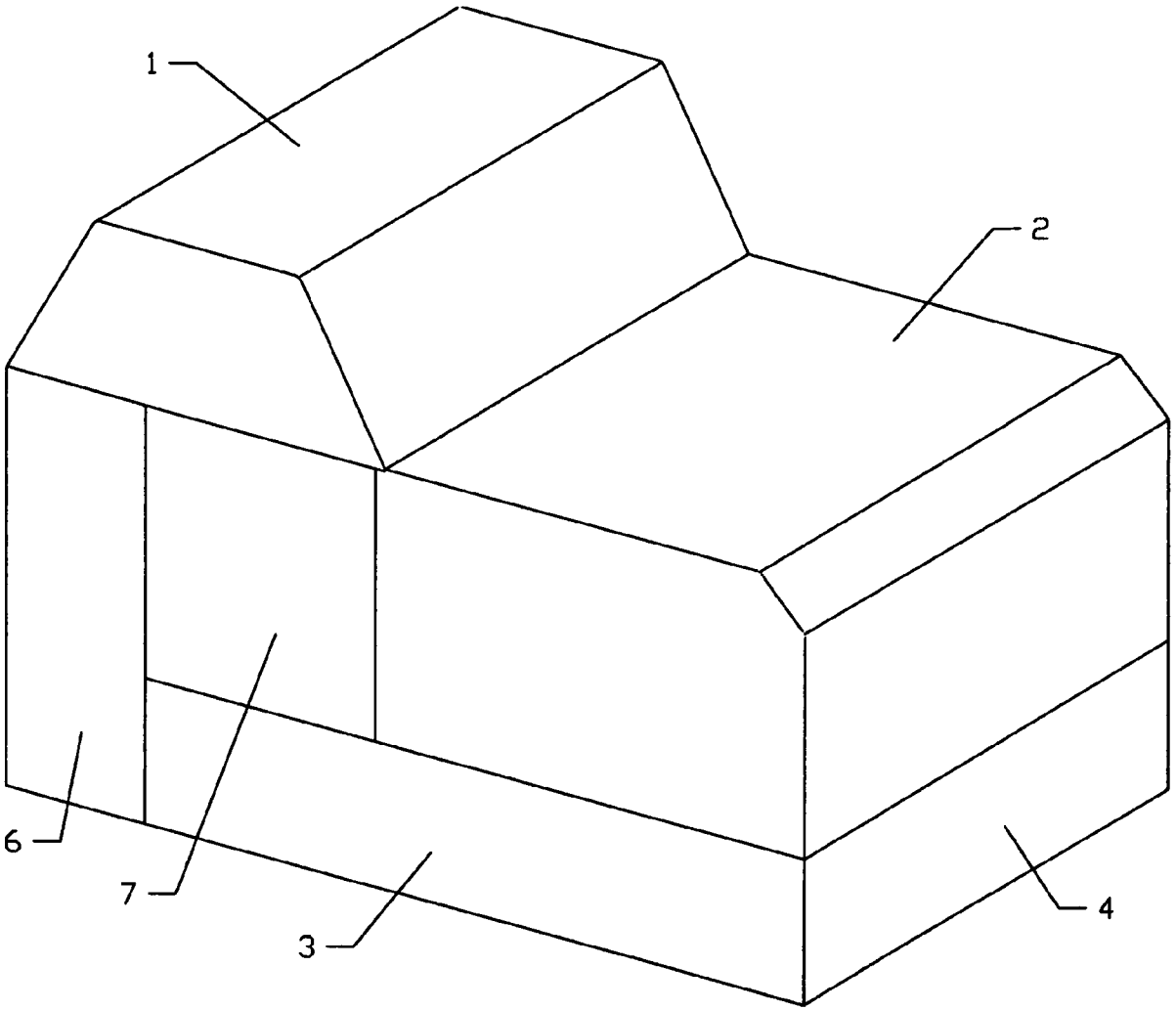
FIG. 1A is a perspective view of a shielding system for a protective bed unit in a closed position.
Figure 1B:
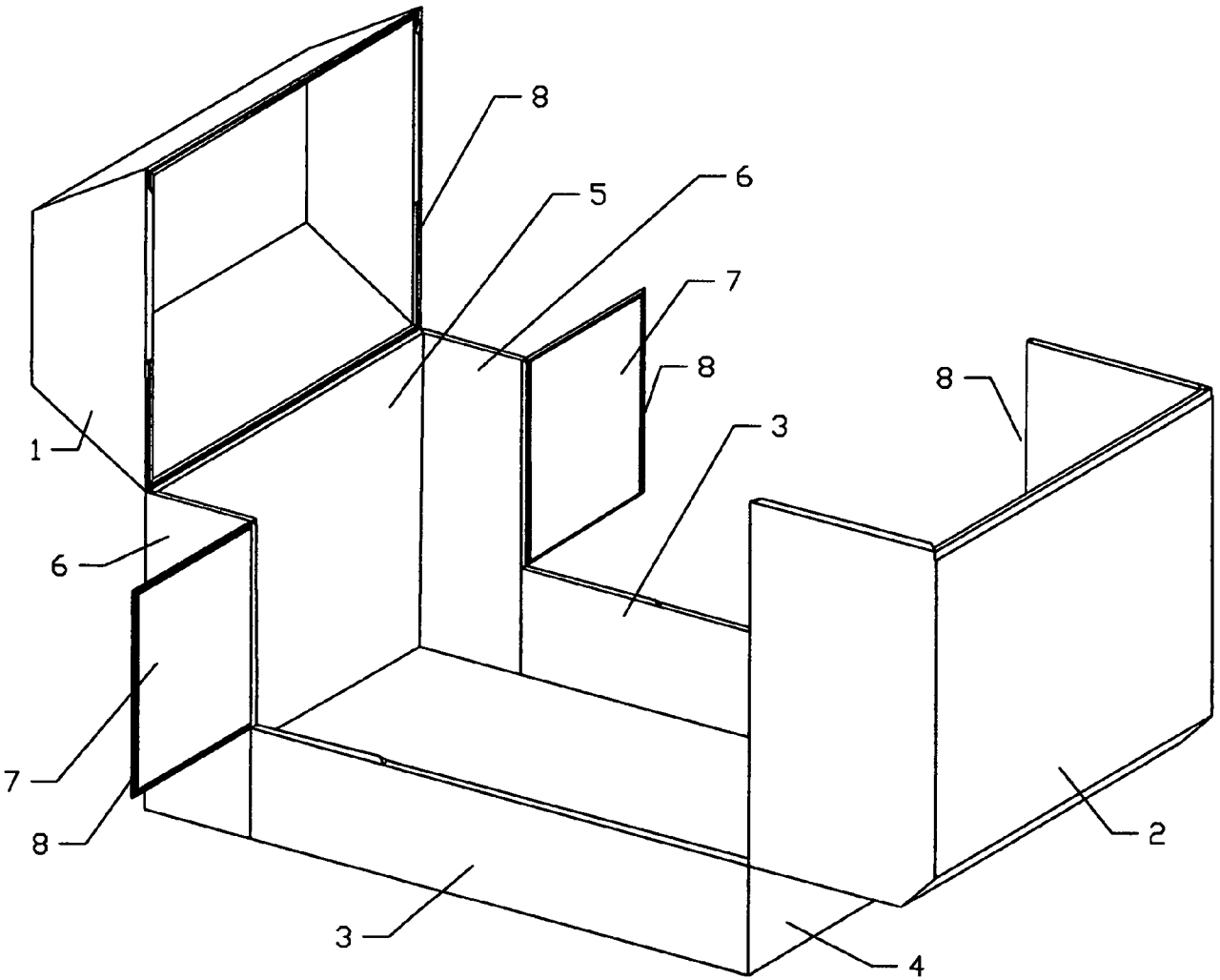
FIG. 1B is a perspective view of a shielding system for a protective bed unit in an open position.
Figure 3:
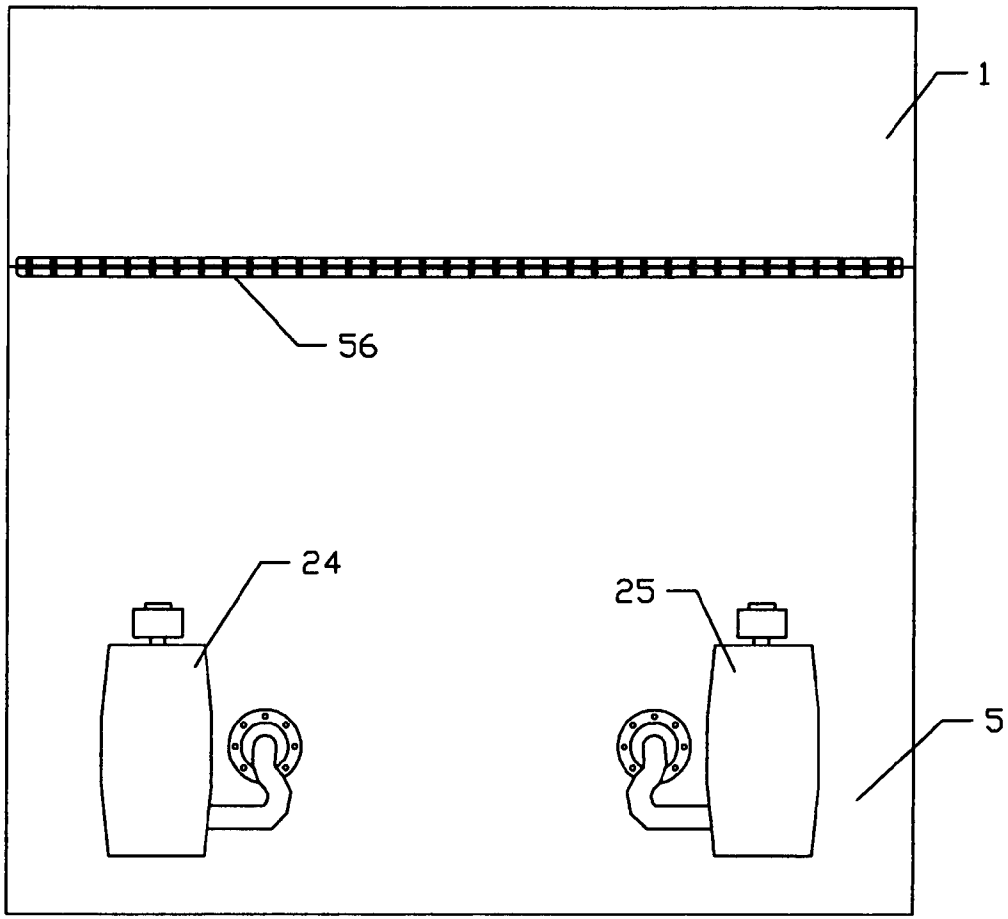
FIG. 3 is an elevation view and showing the protective bed unit from a headboard end.
Figure 4:
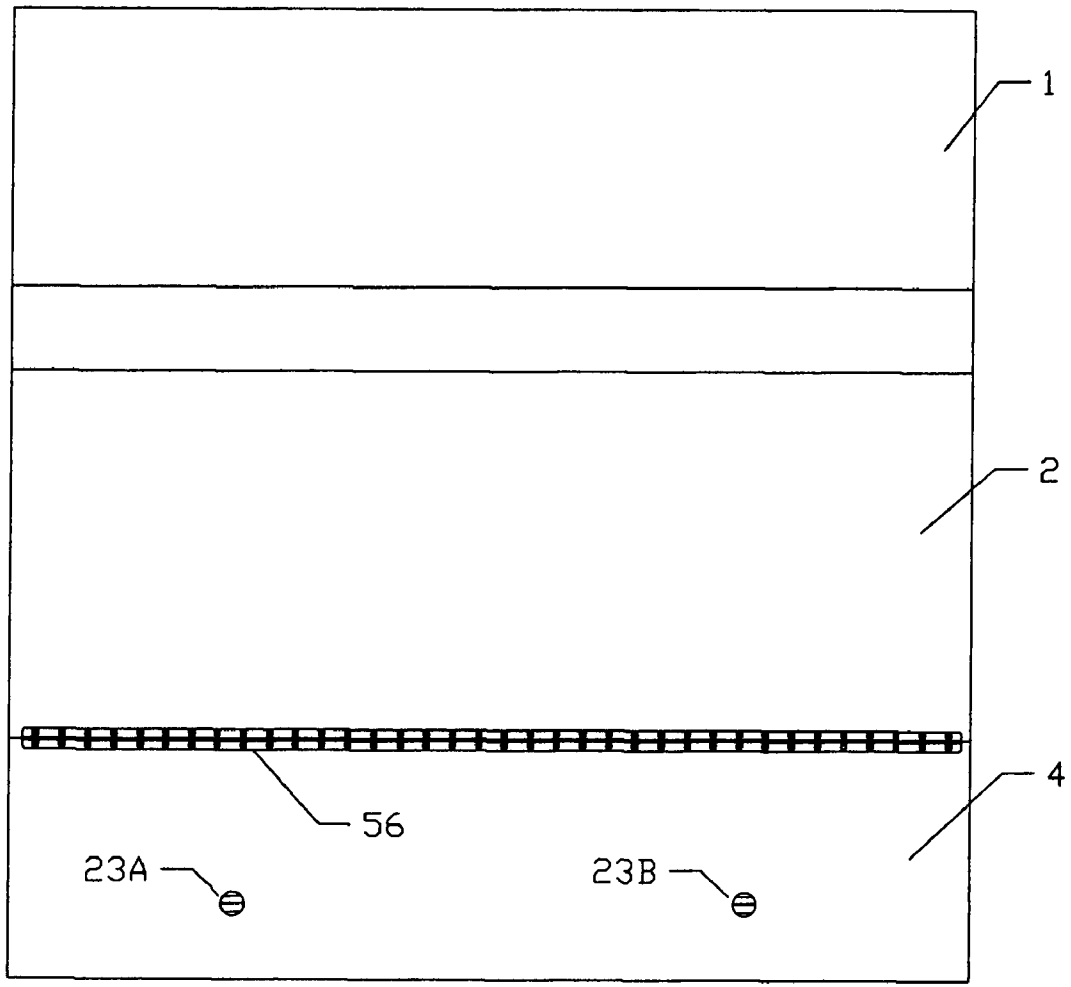
FIG. 4 is an elevation view and showing the protective bed unit from a foot end.

Now referring to FIGS. 1A and 1B which depict the shielding system of the unit in a closed and open position, respectively. The shielding material comprises a canopy 1 and leg cover 2. Typically, canopy 1 and leg cover 2 comprise polycarbonate material that includes a one-way mirror effect such that an occupant sees out while an intruder cannot see inside the closed unit. This effect may be achieved by coating the polycarbonate material with a dark window film that may be bought at auto supply or other such stores. The canopy 1 and leg cover 2 are hingedly affixed to back headboard plating 5 and foot frame plating 4 as shown in FIGS. 3 and 4. Thus, the shielding system may be opened as shown in FIG. 1B such that the occupant can sleep with the shielding in an open position.

The shielding system also includes side frame plating 3, foot frame plating 4, back headboard plating 5 and side headboard plating 6. The plating may comprise polycarbonate material or other alternative materials, some of which are listed above. The plating is affixed to the frame of the protective bed unit by fastening devices such as rivets or bolts. A sealant may be applied between the plating and the frame for assuring that an effective seal is created.

Figure 5:
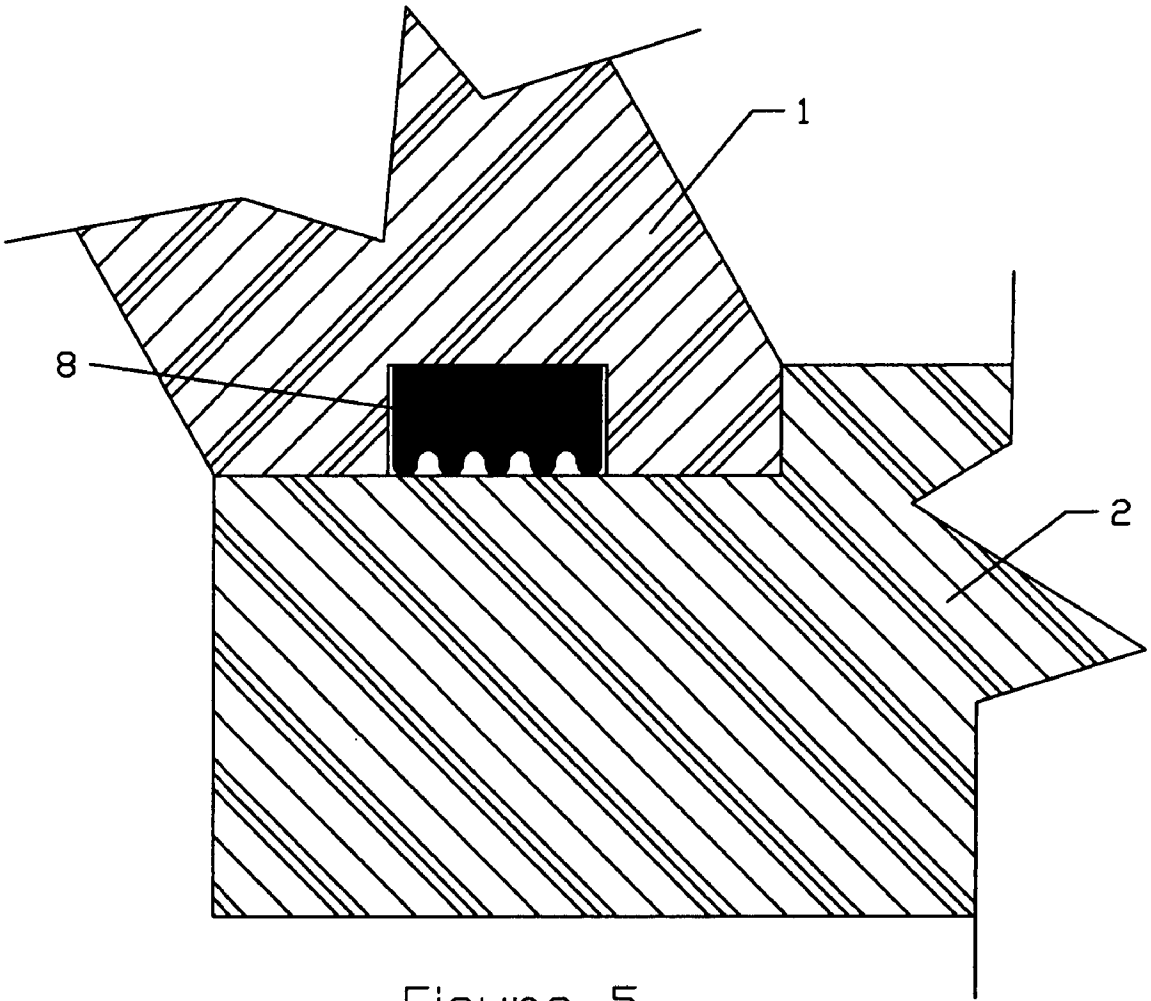
FIG. 5 is a cross section view of an air-tight seal.
Figure 6A:
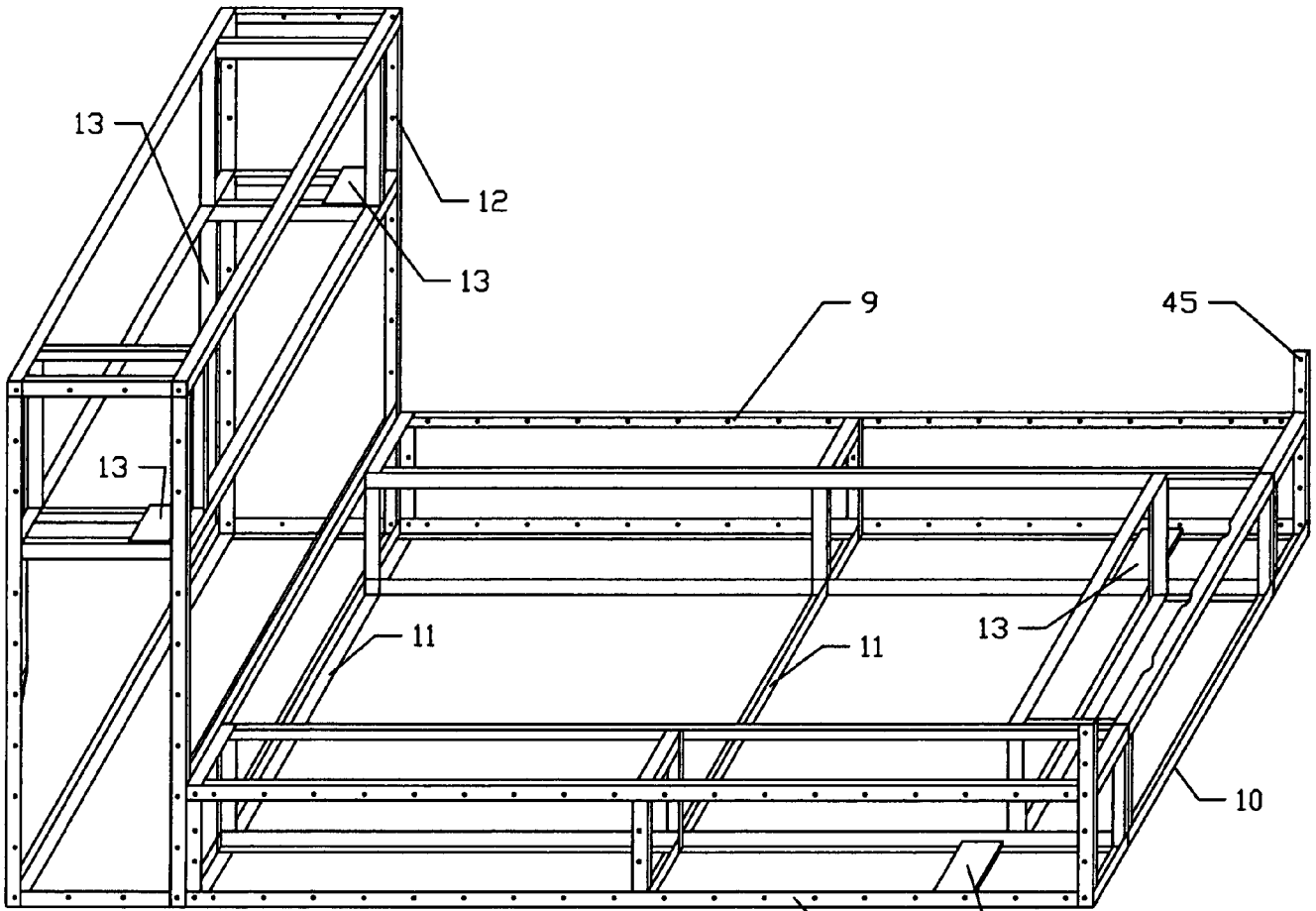
FIG. 6A is a perspective view of a frame for the protective bed unit.
Figure 6B:
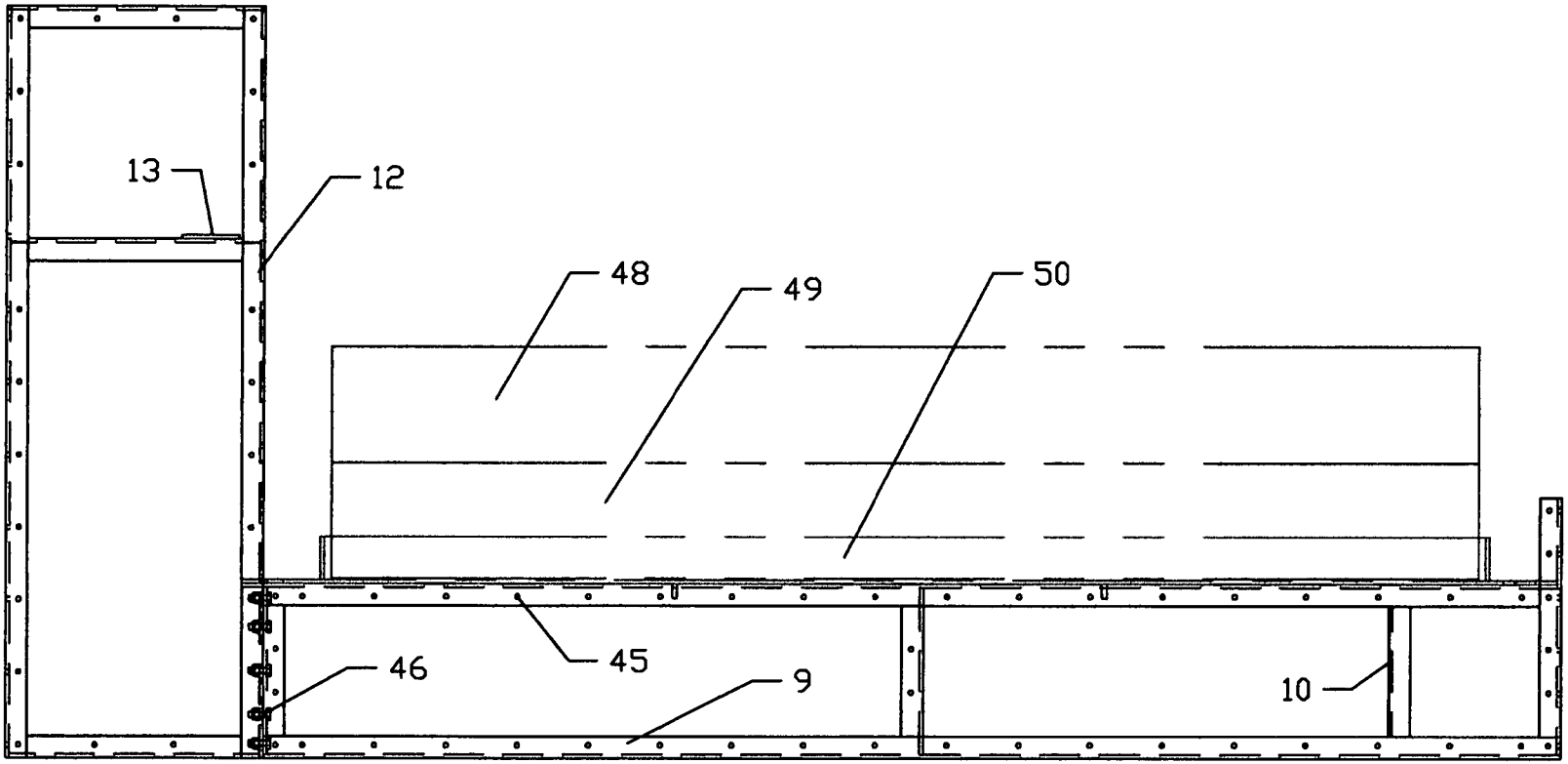
FIG. 6B is an elevation view taken from the side of the frame for the protective bed unit.
Figure 6C:
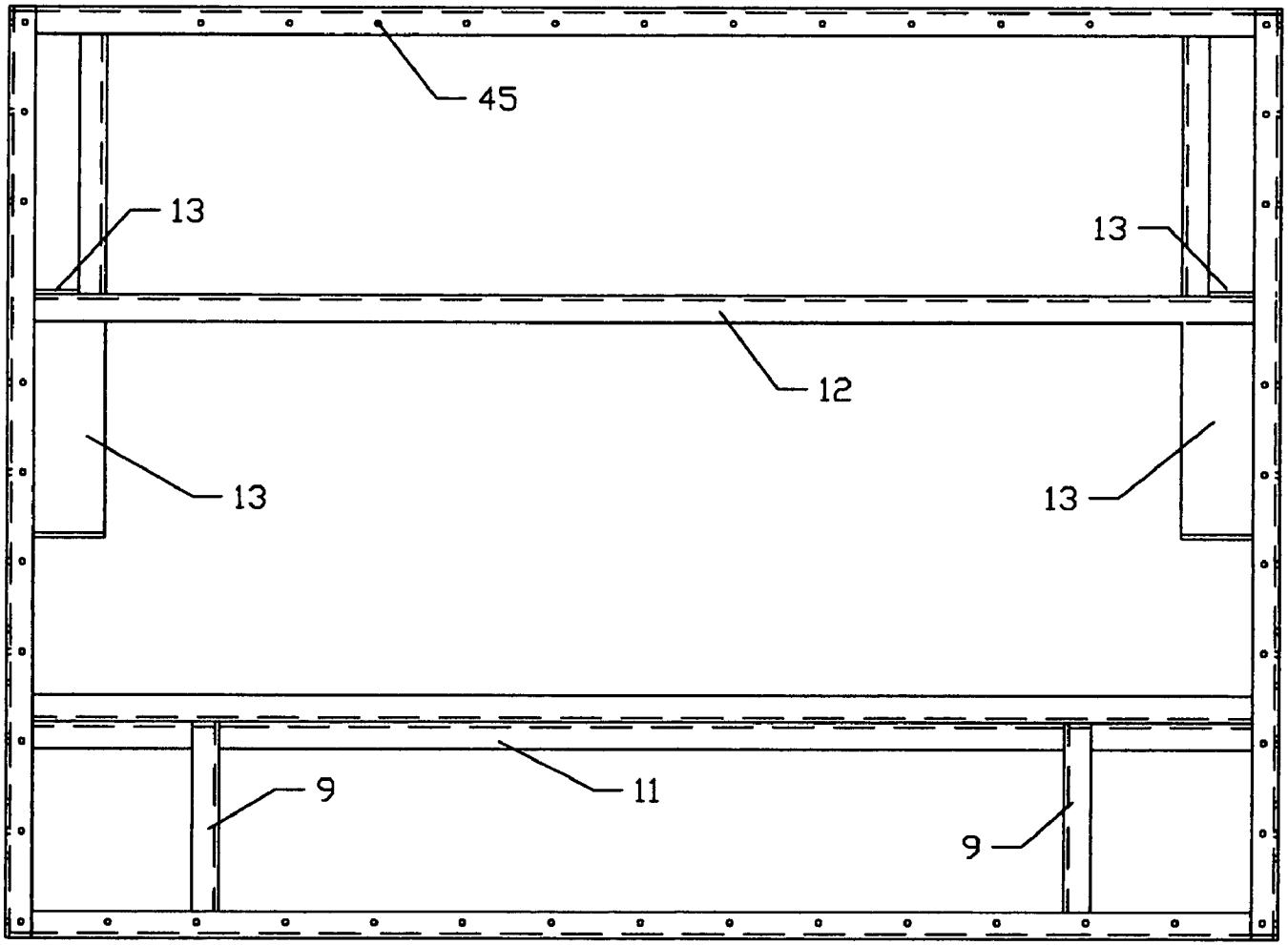
FIG. 6C is an elevation view taken from the headboard end of the frame of the protective bed unit.
Figure 6D:
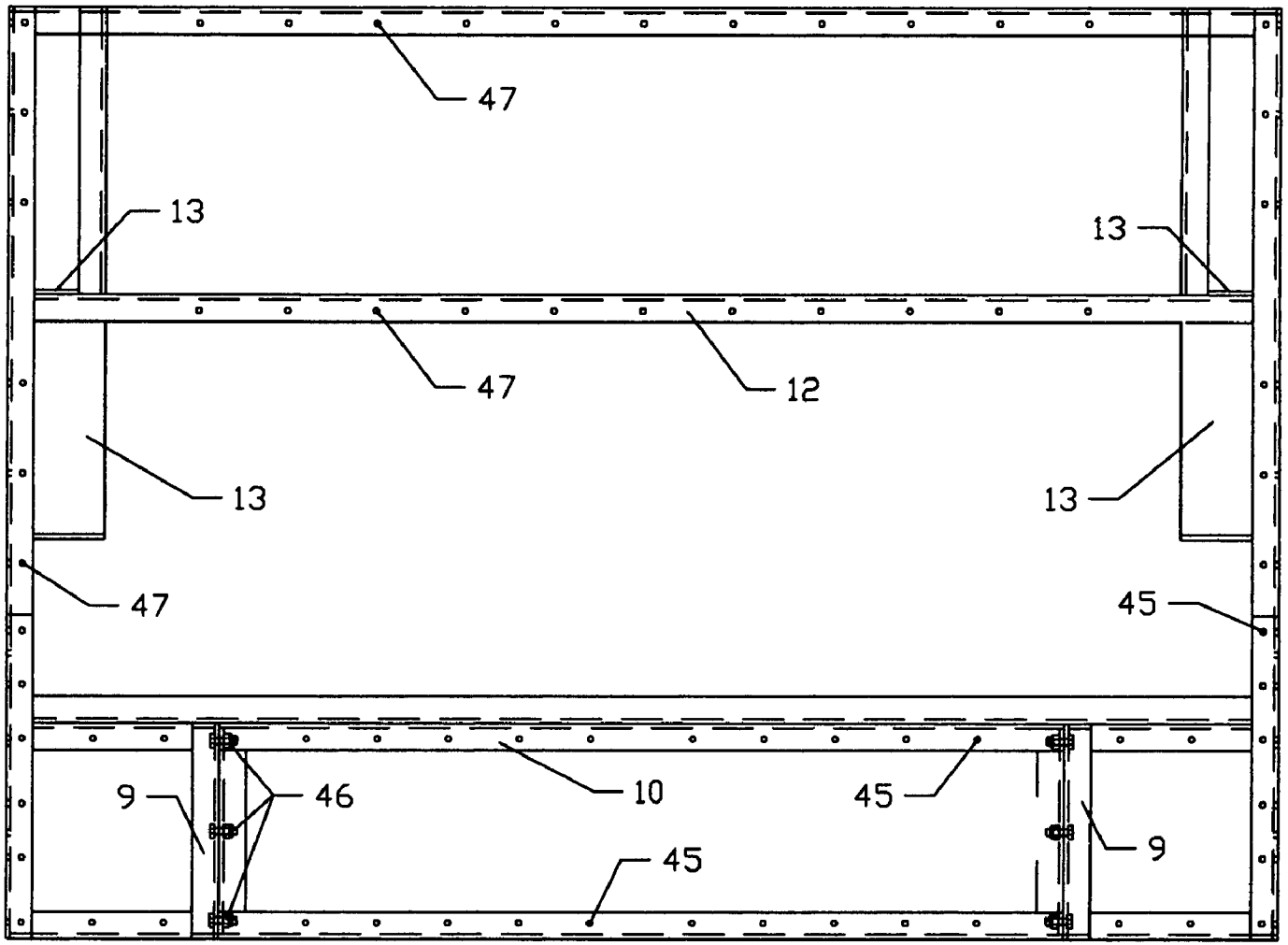
FIG. 6D is an elevation view taken from the foot end of the frame of the protective bed unit.

Doors 7 comprise shielding material and are hingedly affixed to side headboard plating 6 for gaining access to the interior of the unit. The matting surfaces of the canopy 1, leg cover 2 and doors 7 include grooves with rubber seals 8 inserted therein. The seals 8 are compressed when the unit is closed to create an airtight seal as shown in FIG. 5.

Figure 2:
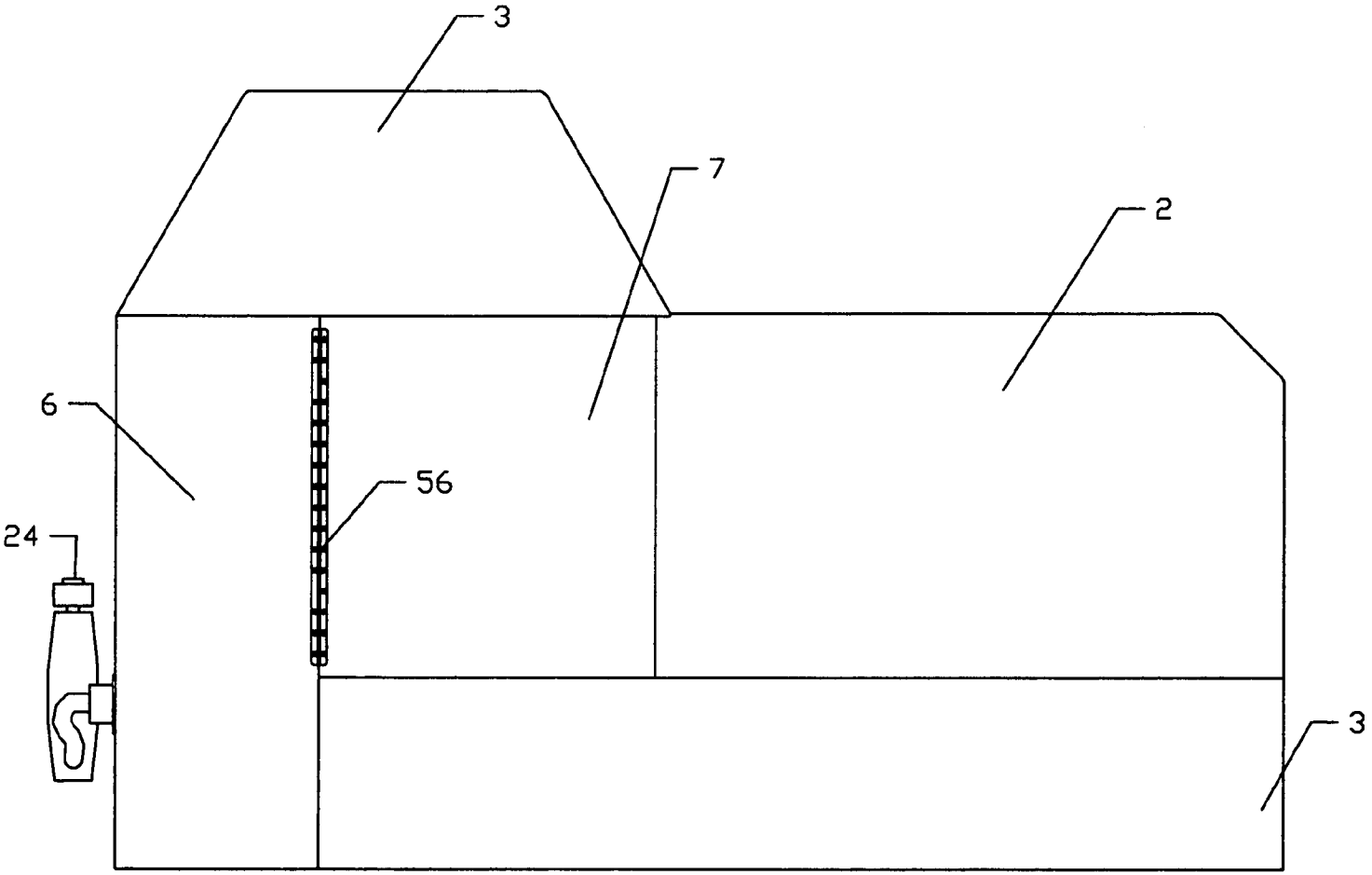
FIG. 2 is an elevation view of the protective bed unit from the side.

FIGS. 2 through 4 are perspective views of the protective bed unit. Hinge 56 attaches door 7 to side headboard plating 6. External hinges 56 also attach the canopy 1 and leg cover 2 to the headboard and foot frame plating respectively. Filters 24 and 25 are also attach to back headboard plating 5. Outlet ducts 23A allow filtered air to exit the air tight chamber.

Now turning to FIGS. 6A–D which show perspective views of the frame that supports the shielding system and bedding. The frame comprises side bed frame elements 9 that are formed in a box-like structure on either side of the unit as shown. Bed frame brace members 11 connect the two box-like structures together via fastening devices such as rivets. The box-like structures are fastened at one end to the foot bed frame elements 10 and at an opposite end to the headboard 12. Hex head bolts and nuts 46 affix the side bed frame elements 9 to the headboard 12. A mattress base 50 sits atop the box-like structures and is shown in phantom in FIG. 6B. Box spring 49 and mattress 48 rest atop the mattress base 50. Actuator bases 13 are arranged as shown to provide support surfaces for lifting the canopy 1 and leg cover 2.

Figure 7A:
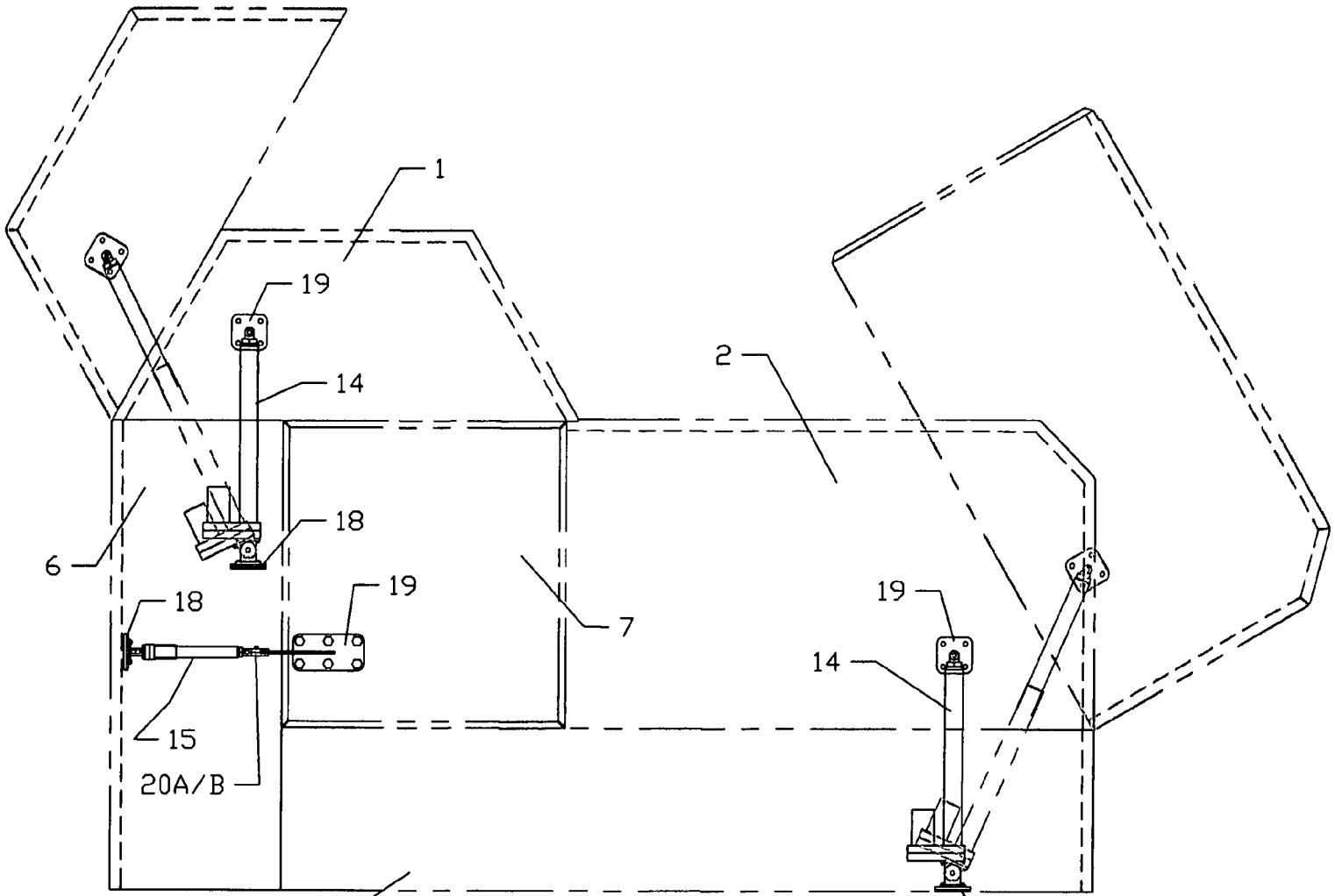
FIG. 7A is an elevation view of the protective bed unit and showing the cover operating system.
Figure 7B:
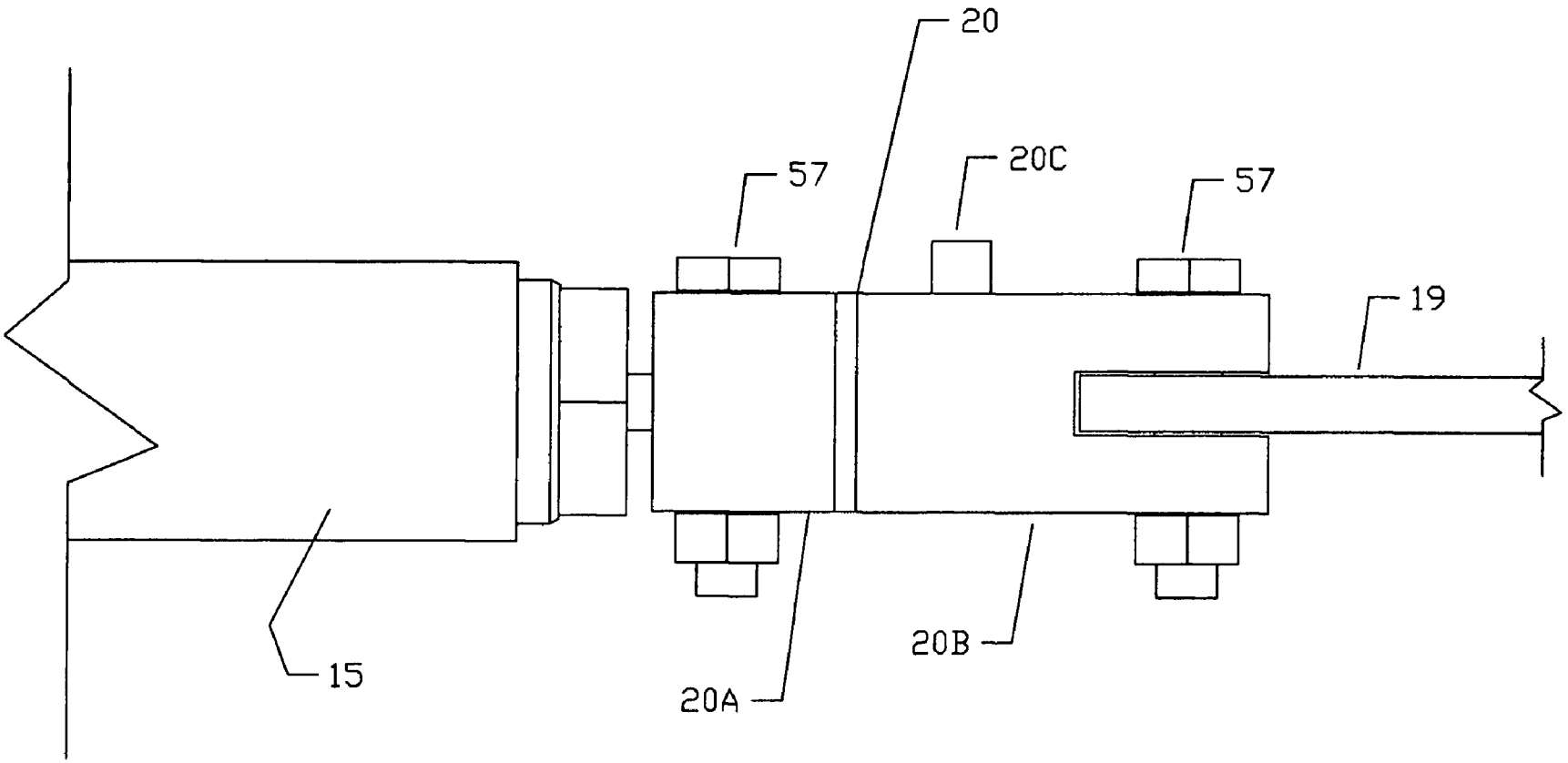
FIG. 7B is an elevation view of a door actuator and showing the quick release button.
Figure 7C:
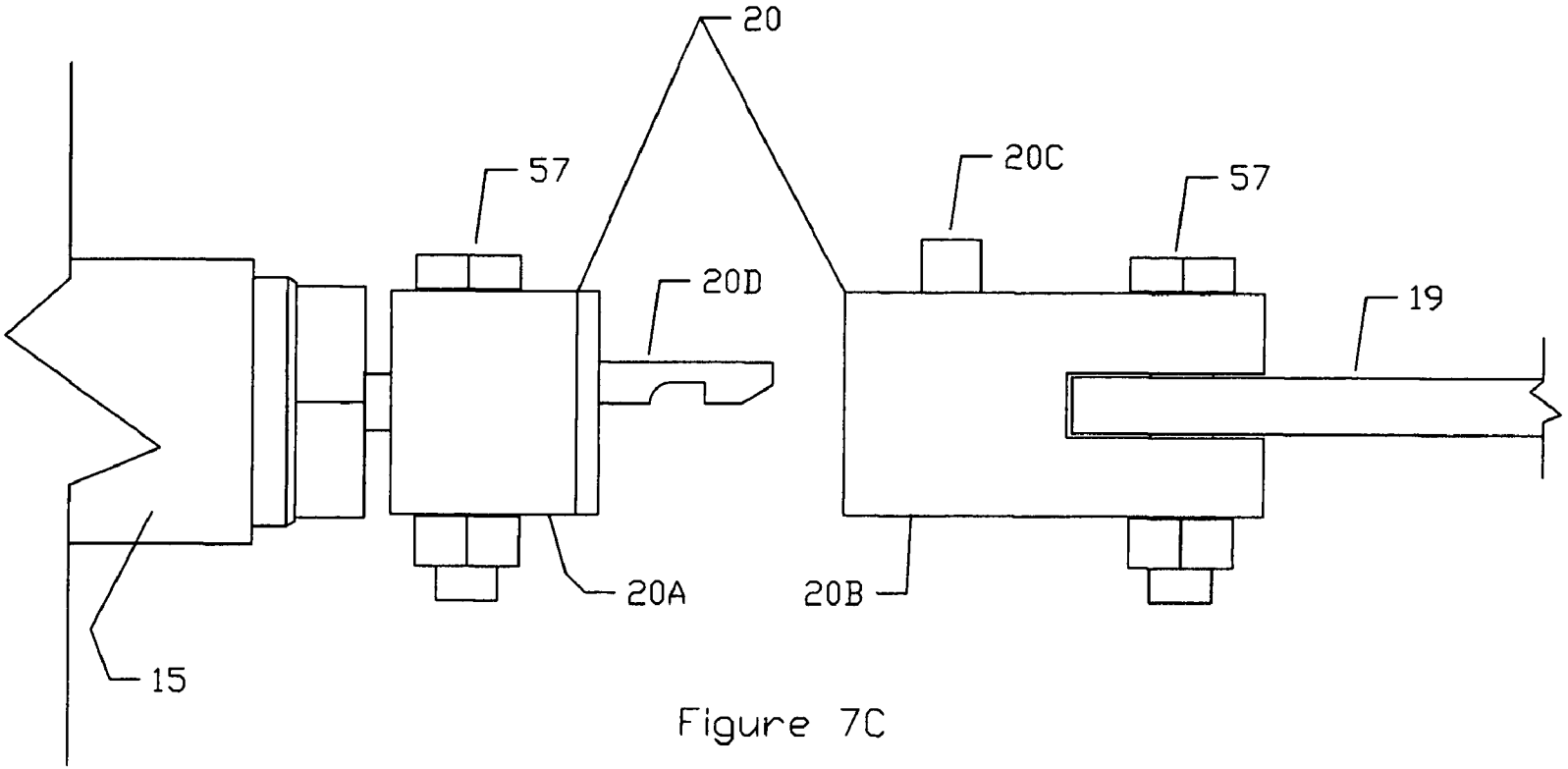
FIG. 7C is an elevation view of the door actuator after the quick release button has been actuated.

FIG. 7A depicts cover actuators 14 in the open and closed position. An end of a cover actuator includes an actuator mounting base plate 18 that is affixed to actuator base 13. An opposite end of the actuator 14 attaches to an actuator mounting lift plate 19 that attaches to canopy 1. Likewise, an actuator is coupled to leg cover 2 for raising it to an open position or lowering it into a closed position as shown.

Each door 7 includes a door actuator 15 for opening and closing the doors. The door actuator 15 includes a quick release link 20 for manually disengaging the actuator 15. Bolts 57 secure the halves of the quick release link 20 to the actuator 15. A spindle 20D having a key notch and projecting from first half 20A couples the halves 20A and 20B together. Half 20B includes a female complementary receptacle (not shown) for accepting the spindle 20D.

Figure 8A:
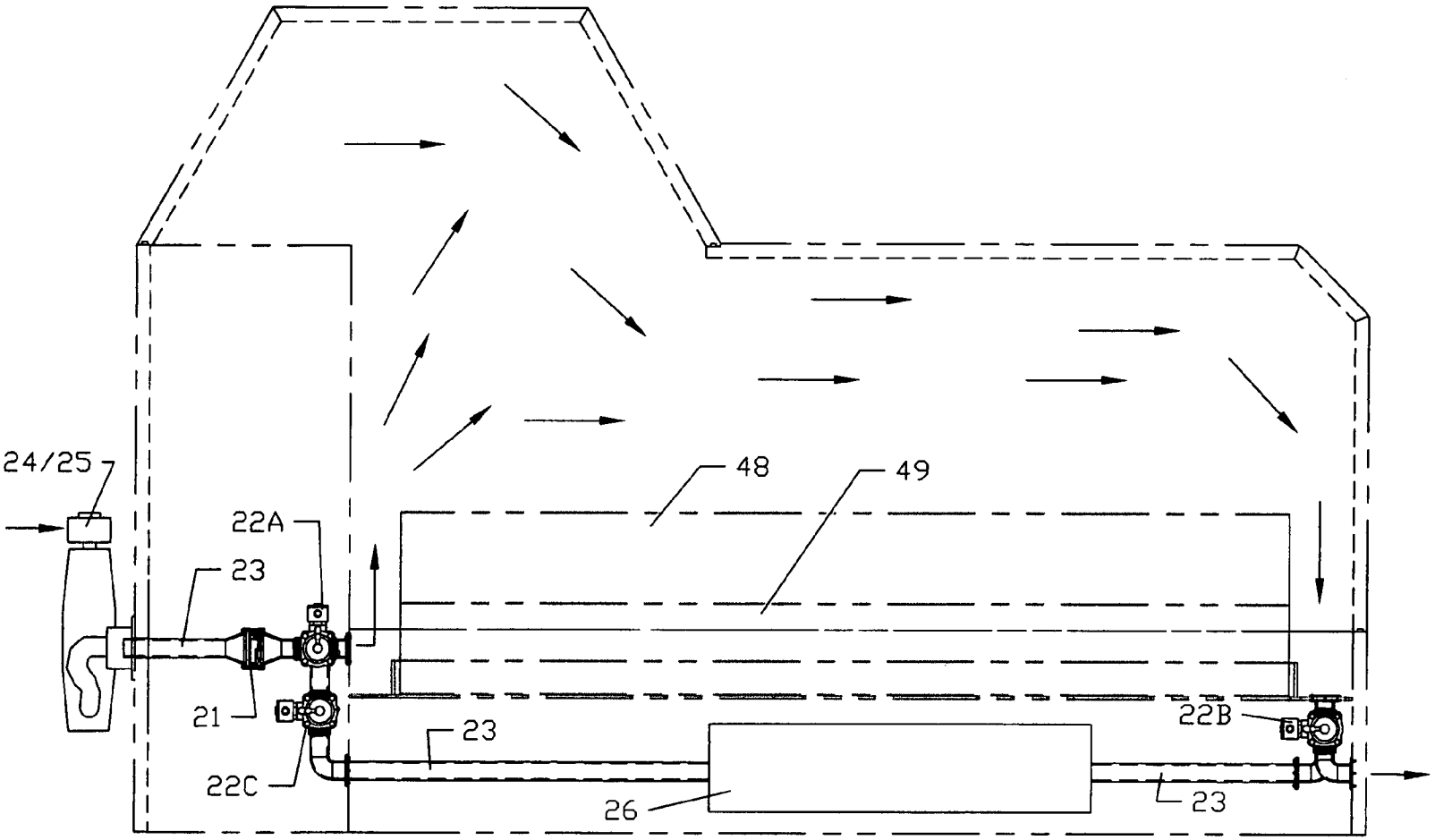
FIG. 8A is an elevation view of the protective bed unit and showing the ventilation system.
Figure 8B:
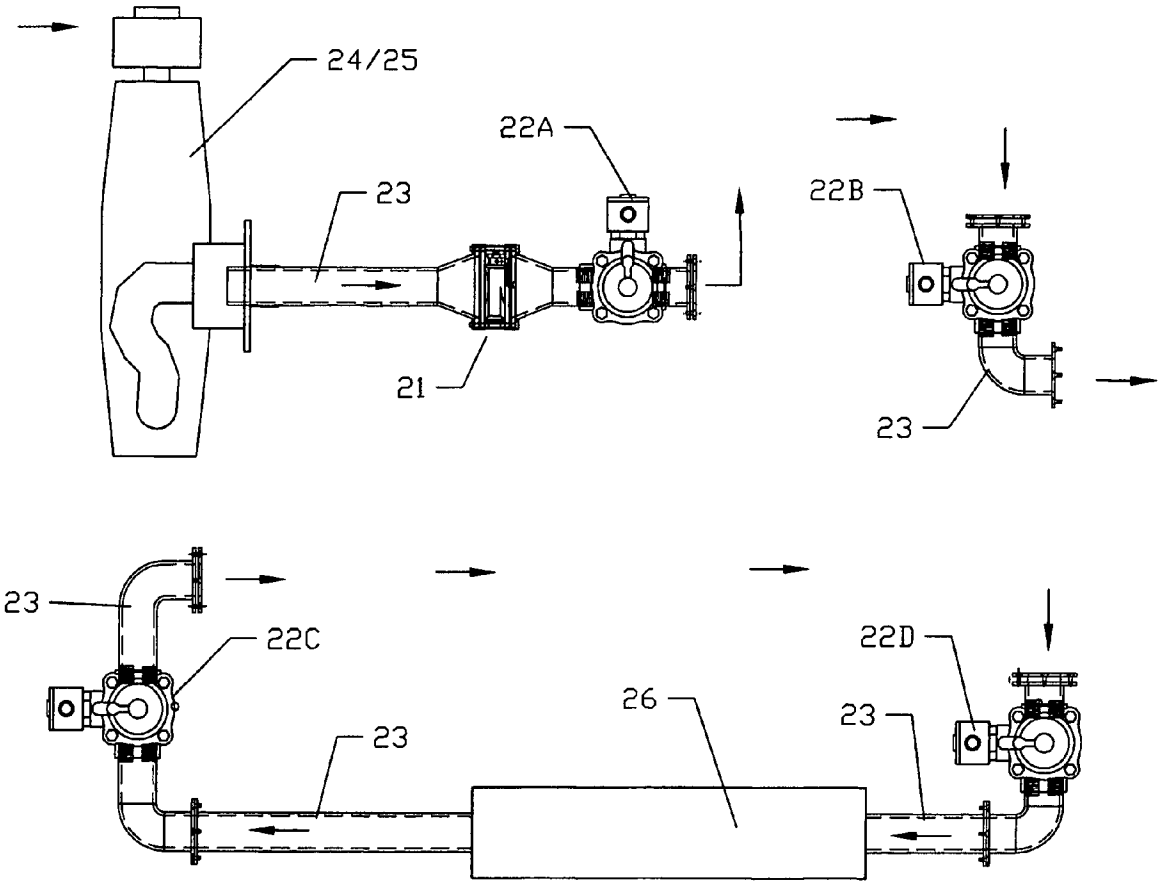
FIG. 8B is a perspective view of the ventilation system and showing the rebreather.
Figure 8C:
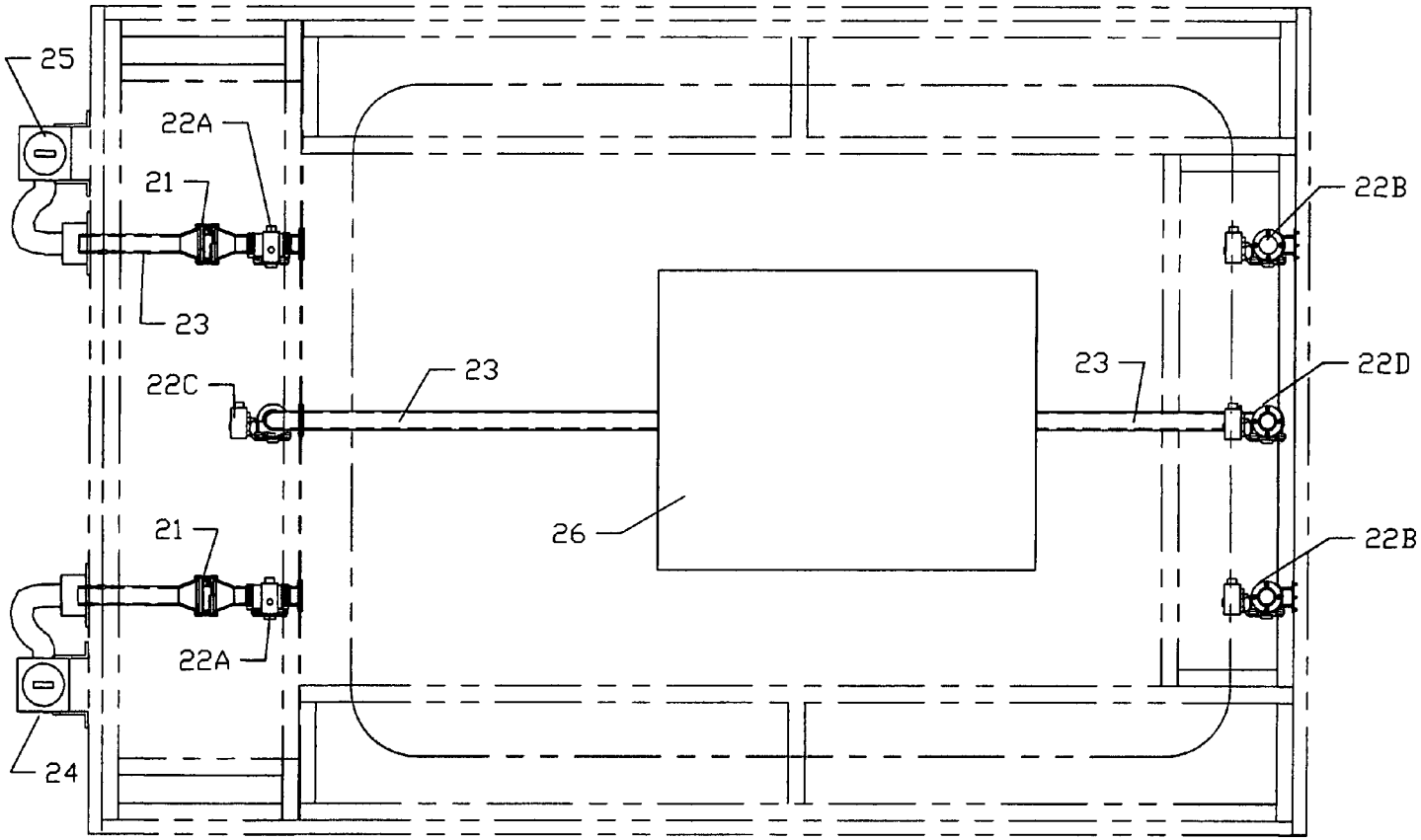
FIG. 8C is a plan view of the ventilation system.

Now turning to the ventilation system shown in FIGS. 8A through 8C, the ventilation system includes two filters a hepa/dust filter 24 and a bio-chemical filter 25. The hepa/dust filter 24 is used during ordinary venting operations. In emergency situations such as during a gas attack, the bio-chemical filter 25 filters the air supply entering the unit. The unit may automatically switch from the dust filter 24 to the bio-chemical filter 25 when the bio-chemical agent sensor 32 detects the presence of an agent.

Vent fans 21 pull external air through the filters 24 and 25. Arrows shown in these drawings indicate the direction of air as it flows through various parts of the ventilation system. Vent solenoid valves 22 control whether the air will be circulated through the rebreather 26. Valves 22A and 22B control the flow of air through either of the filters 24 and 25. These valves are electronically controlled by the control panel 34 and may be switched over automatically in response to warning sensors. As can be seen in FIG. 8A, air flows into one of the filters 24 or 25 and through duct 23 through valve 22A and into the unit. The air is then pushed out of the unit through valve 22B. These valves 22A and 22B are closed when the rebreather 26 is being operated. As shown in FIG. 8B, when the rebreather 26 is in operation, air is pulled through valve 22D into the rebreather 26 and is scrubbed to remove carbon dioxide and replenish oxygen. The air is pushed through valve 22C and re-circulated into the interior of the unit.

Figure 9:
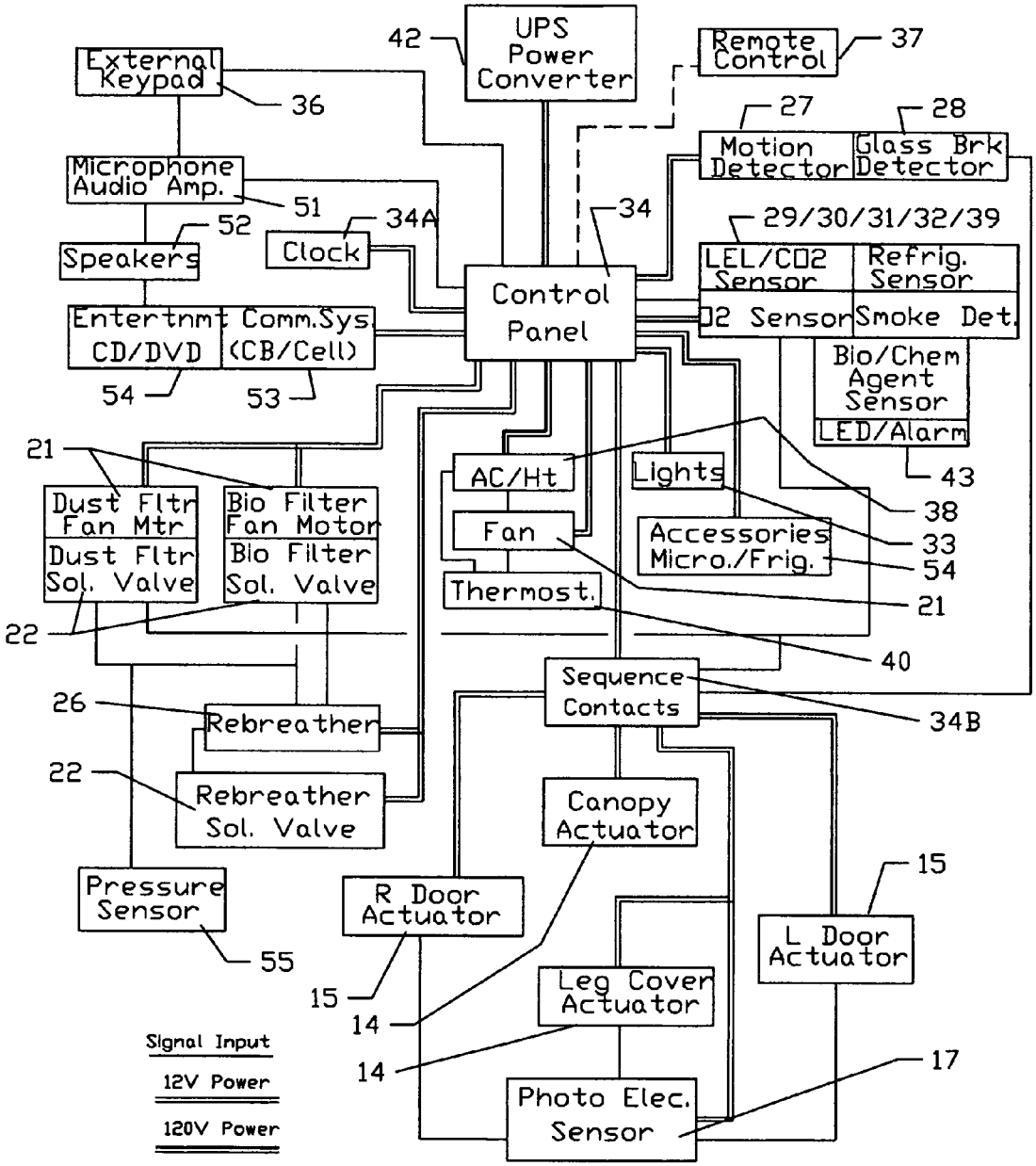
FIG. 9 is a schematic view of the electrical system of the protective bed unit.

FIG. 9 shows a block diagram of the electrical system of the protective bed unit. A motion detector 27 detects motions in the area around the protective bed unit. The operator may place the control panel in a mode that either an alarm may sound or the unit may automatically close should motion be detected around the unit. The controller may also include a feature for detecting glass breakage and acting according to preprogrammed directions.

A smoke detector 29 alerts an occupant when smoke is detected. Oxygen sensor 30 sounds an alarm when the oxygen content of the air becomes too low for safe breathing conditions. An LEL sensor 31 detects the presence of natural or LP gas. Bio-chemical agent sensor 32 senses the presence of biological or chemical agents. Other such sensors and detectors may be included such as pressure sensor 55. Sensors may include those sold by Figaro such as a carbon dioxide sensor model number TGS4160, and oxygen sensor model KE-25. The control panel 34 allows the user to select from a wide variety of modes. An external key pad 35 provides a means for locking the door 7 of the unit when away. A user then enters a numerical password to gain entry into the unit. Cabinet lights 33 are included in the unit for providing a user with a light source.

The unit may include a remote unit 37 for remotely controlling the unit. A heating and air conditioning unit 38 provides climate control for the interior temperature of the unit. The unit may be equipped with a refrigerant gas sensor 39 for detecting the leaking of coolant gas into the unit, which may lead to a dangerous condition. The heating and air conditioning unit 38 to maintain a desired temperature uses a thermostat 40 or temperature sensor.

The unit includes a backup power source 42 for operating the unit when the primary power source has failed. The system might include visual warning lights such as LED 43. An audio amplifier 51 amplifies external sounds such that the user can hear them being broadcast through speakers 52. A communication system 53 is provided as discussed above. Entertainment system 54 may include a stereo, DVD player, television or the like.

I claim:

1. A protective bed unit comprising:

a frame including a headboard and at least one actuator base;

shielding material forming a canopy and leg cover to create a protective chamber and attached to said frame;

at least one door hingably affixed to said shielding material for allowing ingress and egress to the protective chamber;

a ventilation system having ductwork passing through said shielding material for filtering air that passes into the protective chamber, said ventilation system including at least one filter, a fan and an electronically actuated valve; and, a door actuator attached between said shielding material and said door and for opening and closing said door wherein said door actuator includes a quick release mechanism for allowing an operator to disengage the actuator from the door such that the door may be opened manually.

2. The protective bed unit of claim 1 further comprising a rebreather located within the protective chamber for scrubbing carbon dioxide from air circulated through the rebreather.

3. The protective bed unit of claim 1 further comprising at least one cover actuator for opening the canopy, said actuator including a base plate attached to said actuator base and a lift plate attached to said shielding material.

4. The protective bed unit of claim 1 further comprising a controller for controlling operation of the ventilation system and opening and closing of the shielding material and door.

5. The protective bed unit of claim 4 further comprising sensors connected to said controller for detecting different environmental conditions.

6. The protective bed unit of claim 1 further comprising seals located on at least and edge of said door and for sealing the unit when said door is closed.

7. A protective bed unit comprising:

a frame including a headboard and at least one actuator base;

shielding material forming a canopy and leg cover to create a protective chamber and attached to said frame;

at least one door hingably affixed to said shielding material for allowing ingress and egress to the protective chamber;

a ventilation system having duct work passing through said shielding material for filtering air that passes into the protective chamber, said ventilation system including at least one filter, a fan and an electronically actuated valve;

a rebreather located within the protective chamber for scrubbing carbon dioxide from air circulated through the rebreather;

at least one cover actuator for opening the canopy, said actuator including a base plate attached to said actuator base and a lift plate attached to said shielding material;

a door actuator attached between said shielding material and said door and for opening and closing said door, said door actuator includes a quick release mechanism for allowing an operator to disengage the actuator from the door such that the door may be opened manually;

a controller for controlling operation of the ventilation system and opening and closing of the shielding material and door;

at least one seal in contact with an edge of said door and for sealing the protective chamber; and sensors connected to said controller for detecting different environmental conditions.

8. A protective bed unit comprising:

a protective chamber surrounded by shielding material;

a frame attached to said shielding material;

a door for providing access to said protective chamber;

a ventilation system for filtering air that passes into said protective chamber;

a seal in contact with said door for sealing the protective chamber when the door is closed; and, a door actuator attached between said shielding material and said door and for opening and closing said door wherein said door actuator includes a quick release mechanism for allowing an operator to disengage the actuator from the door such that the door may be opened manually.

9. The protective bed unit of claim 8 further comprising a frame having a headboard and at least one actuator base.

10. The protective bed unit of claim 8 wherein said shielding material forms a canopy and leg cover.

11. The protective bed unit of claim 8 wherein said ventilation system includes at least one filter, a fan and an electronically actuated valve.

12. The protective bed unit of claim 8 further comprising a rebreather located with the protective chamber for scrubbing carbon dioxide from air circulated through the rebreather.

13. The protective bed unit of claim 8 further comprising at least one cover actuator for opening the canopy, said actuator including a base plate attached to said actuator base and a lift plate attached to said shielding material.

14. The protective bed unit of claim 8 further comprising a controller for controlling operation of the ventilation system and opening and closing of the shielding material and door.

15. The protective bed unit of claim 14 further comprising sensors connected to said controller for detecting different environmental conditions.

* * * * *